United States Patent [19]

Lelental et al.

[11] 4,152,155

[45] May 1, 1979

[54] ORGANOTELLURIUM (II) AND (IV) COMPOUNDS IN HEAT-DEVELOPABLE IMAGING MATERIALS AND PROCESS WITH PHYSICALLY DEVELOPABLE NUCLEI

[75] Inventors: Mark Lelental, Penfield; Henry J. Gysling, Rochester, both of N.Y.

[73] Assignee: Eastman Kodak Company, Rochester, N.Y.

[21] Appl. No.: 848,063

[22] Filed: Nov. 3, 1977

Related U.S. Application Data

[63] Continuation-in-part of Ser. No. 703,477, Jul. 8, 1976, abandoned.

[51] Int. Cl.[2] ..... G03C 5/24; G03C 1/76; G03C 1/00; G03C 1/02

[52] U.S. Cl. ..... 96/48 PD; 96/67; 96/88; 96/114.1

[58] Field of Search ..... 96/114.1, 48, 48 PD, 96/48 HD, 67, 109, 88, 66 T

[56] References Cited

U.S. PATENT DOCUMENTS

| | | | |
|---|---|---|---|
| 1,939,232 | 12/1933 | Sheppard et al. | 96/114.1 |
| 2,868,643 | 1/1959 | DeJonge et al. | 96/48 R |
| 3,130,052 | 4/1964 | Dippel et al. | 96/48 R |
| 3,152,904 | 10/1964 | Sorenson et al. | 96/48 PD |
| 3,223,525 | 12/1965 | Jonker et al. | 96/48 PD |
| 3,392,020 | 7/1968 | Yutzy et al. | 96/114.1 |
| 3,457,075 | 7/1969 | Morgan et al. | 96/114.1 |
| 3,650,748 | 3/1976 | Yudelson et al. | 96/48 PD |
| 3,700,448 | 10/1972 | Hillson | 96/48 PD |
| 3,708,304 | 1/1973 | Hiller | 96/114.1 |
| 3,874,946 | 4/1975 | Costa et al. | 96/114.1 |
| 4,066,460 | 1/1978 | Chang et al. | 96/48 HD |
| 4,076,537 | 2/1978 | Tsuboi | 96/48 HD |

FOREIGN PATENT DOCUMENTS

| | | | |
|---|---|---|---|
| 786235 | 7/1972 | Belgium | 96/114.1 |
| 2233868 | 2/1973 | Fed. Rep. of Germany | 96/48 R |
| 2504652 | 8/1975 | Fed. Rep. of Germany | 96/114.1 |
| 2522778 | 12/1975 | Fed. Rep. of Germany | 96/48 HD |
| 1161777 | 8/1969 | United Kingdom | 96/114.1 |
| 1405628 | 9/1975 | United Kingdom | 96/48 R |

*Primary Examiner*—J. Travis Brown
*Assistant Examiner*—L. Falasco
*Attorney, Agent, or Firm*—Richard E. Knapp

[57] ABSTRACT

An imaging combination comprising (i) a tellurium (II) or (IV) compound as an oxidizing agent and (ii) a reducing agent provides an improved amplified image. This imaging combination is useful in heat-developable materials containing sources of physically developable nuclei. A developed image can be provided in the material containing the developable nuclei and can be provided by heating the element to moderately elevated temperatures.

21 Claims, No Drawings

ORGANOTELLURIUM (II) AND (IV) COMPOUNDS IN HEAT-DEVELOPABLE IMAGING MATERIALS AND PROCESS WITH PHYSICALLY DEVELOPABLE NUCLEI

This is a continuation-in-part application of U.S. Pat. application Ser. No. 703,477 of Mark Lelental and Henry J. Gysling, filed July 8, 1976 now abandoned.

BACKGROUND OF THE INVENTION

1. Field of the Invention

This invention relates to heat-developable imaging materials and processes for developing an image employing an image-forming combination comprising (i) a tellurium (II) or (IV) compound as an oxidizing agent with (ii) a reducing agent. In one of its aspects, it relates to a heat-developable imaging element comprising an oxidation-reduction image-forming combination comprising (i) a tellurium (II) or (IV) compound as an oxidizing agent with (ii) a reducing agent and physically developable metal nuclei. Another aspect of the invention relates to a heat-developable imaging composition comprising the described image-forming combination.

2. Description of the State of the Art

It is known to provide an image with an imaging material, especially a photographic imaging material by so-called dry processing with heat. These materials are sometimes described as heat-developable photographic materials or photothermographic materials. Such heat-developable photographic materials after imagewise exposure are heated to provide a developed image in the absence of processing solutions or baths.

It has been desirable to provide reduced silver concentrations in heat-developable imaging materials. Attempts have been made in the past to provide this desired reduced silver concentration. For example, U.S. Pat. No. 3,152,903 of Shepard et al., issued Oct. 13, 1964 describes a so-called dry-processable imaging material containing a non-silver material. It is indicated that the image-forming composition can comprise a latent irreversible oxidation-reduction reaction composition which is capable of initiation by electron transfer from a non-silver photocatalyst. The photocatalyst can be, for example, zinc oxide or titanium dioxide. A disadvantage of the imaging material described in this patent is that the image formation is not carried out using amplification as in most heat-developable silver photographic materials. It has been desirable to overcome this problem by providing a more effective non-silver heat-developable material, that is a material which enables desired latent image amplification.

An amplification step is an important factor in increased speed imaging materials. In such materials, a catalyst is generally formed by imagewise exposure of a photosensitive material. The resulting invisible or latent image formed is then used to catalyze the reduction of a material in a high oxidation state to a visible image in a low oxidation state. In silver halide photographic materials, for example, exposure of photographic silver halide to light results in formation of silver nuclei which then catalyze the further reduction of silver halide to silver in the presence of a reducing agent.

It has also been known to produce tellurium images by disproportionation of tellurium dihalides. The images are formed in the presence of the processing liquid which helps in the disproportionation. Some unexposed tellurium dihalides, however, are dark in color causing poor image discrimination. Further, the tellurium dihalides are typically unstable in air and undergo light-induced decomposition only when moistened with an organic solvent. Accordingly, the tellurium dihalides would be expected to be disadvantageous in imaging materials designed for dry processing.

It is also known that certain tellurium (IV) compounds wherein the tellurium is bonded directly to a carbon atom can be used in imaging. In Belgian Pat. No. 786,235 issued July 31, 1972, corresponding to U.K. Specification No. 1,405,628, certain tellurium compounds wherein the tellurium is bonded directly to a carbon atom are indicated as useful in image-forming materials. The materials and process described are materials which undergo a so-called unit quantum photoreduction to yield a tellurium image. This material and process are not catalytic, that is, the tellurium (O) formed upon exposure does not catalyze the decomposition or other reaction of the tellurium (IV) compound. The process and material are, therefore, inherently photographically slow in speed and limited in usefulness.

Imaging materials have also been described wherein a substance capable of darkening when heated is heated in the presence of a catalyst such as described in U.S. Pat. No. 1,939,232 of Shepard et al, issued Dec. 12, 1933. This imaging material does not involve a heat-developable photographic material comprising an organotellurium compound. Rather it involves a combination of, for example, silver oxalate and a catalyst resulting from, for example, tellurium dichloride.

Materials are known in the imaging art in which metal nuclei are used for physical development purposes. None of these materials, however, involve nuclei in a heat-developable imaging material comprising tellurium (II) or (IV) compounds.

There has been a continuing need to provide improved tellurium containing heat-developable imaging elements, compositions and processes with physically developable metal nuclei which enable reduced concentrations of silver in the described materials. This continuing need has been especially true for non-silver heat-developable materials which enable amplification of a nuclei image without the need for use of processing solutions.

SUMMARY OF THE INVENTION

It has been found according to the invention that an image can be provided in a heat-developable imaging material comprising in reactive association (a) physically developable metal nuclei selected from the group consisting of chromium, iron, cobalt, nickel, copper, cadmium, selenium, palladium, silver, tin, tellurium, iridium, ruthenium, rhenium, platinum, rhodium, gold and lead nuclei and combinations of these nuclei or metal binary compounds, phosphides, sulfides, oxides, and the like, (b) an oxidation-reduction image-forming combination comprising (i) a tellurium (II) or (IV) compound as an oxidizing agent, especially such as tellurium compound which is selected from coordination complexes and organotellurium derivatives of tellurium (II) and (IV), (ii) a reducing agent, and (c) a binder. The described physically developable nuclei are preferably distributed in the imaging material imagewise.

A visible image in the described heat-developable material can be provided by merely heating the material to moderately elevated temperatures to provide a developed image in the absence of processing solutions or baths.

An important advantage of the described heat-developable material is that it enables an amplification factor which is significantly higher than was enabled by prior heat-developable non-silver materials based on tellurium complexes. For example, an image amplification factor of at least $10^6$ is obtained in the described heat-developable materials. This is believed to be due in part to the fact that the described nuclei enable a catalytic amplification of the latent image. It is also believed to be due in part to the autocatalytic nature of the oxidation-reduction process which is believed to be initiated by the described nuclei.

DETAILED DESCRIPTION OF THE INVENTION

An important embodiment of the invention as described is a heat-developable, imaging element comprising a support having thereon in reactive association (a) physically developable metal nuclei, as described herein, (b) an oxidation-reduction image-forming combination comprising (i) a tellurium (II) or (IV) compound as an oxidizing agent, and (ii) a reducing agent, and (c) a binder. A range of tellurium (II) and (IV) compounds are useful in the described materials as oxidizing agents. Selection of an optimum tellurium (II) or (IV) compound will depend upon such factors as processing conditions, desired image, other components of the imaging material and the like. Especially useful tellurium (II) or (IV) compounds are coordination complexes of tellurium (II) or (IV), typically coordination complexes of tellurium (II) with two univalent bidentate sulfur-containing ligands. The described complexes of tellurium (II) have a coordination number of four. The complexes are characterized by having at least one of the coordinating ligands coordinate to the tellurium through a sulfur atom. However, complexes as described may have any number of tellurium (II) coordination positions occupied by the sulfur atom of a suitable sulfur-containing ligand. The tellurium (II) can be coordinated with a monodentate, bidentate or tridentate sulfur-containing ligand or with combinations of these ligands. The tellurium (II) can also be coordinated with a tetradentate sulfur ligand. The sulfur-containing ligands can be either neutral or anionic.

Useful monodentate sulfur ligands include neutral Lewis base ligands such as thiourea; substituted thiourea, such as ethylene thiourea, N,N'-diphenyl thiourea, 1-(1-naphthyl)-2-thiourea, tetramethyl-2-thiourea; 1-methyl-2-thiourea; 1-butyl-2-thiourea; and the like.

Useful bidentate sulfur ligands include anionic bidentate ligands such as dithiocarbamates represented by the formula

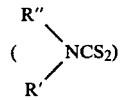

wherein R' and R'' are each hydrogen, aryl, such as phenyl, benzyl, alkyl containing 1 to 6 carbon atoms, including methyl, ethyl, propyl, isopropyl, cyclohexyl or heterocyclic, such as a 5 or 6 member heterocyclic group including, for example, N-furfuryldithiocarbamate and the like with at least one of R' and R'' being aryl, alkyl or heterocyclic or R' and R'' can together represent the atoms, especially the carbon and oxygen atoms, necessary to complete a five- or six-membered heterocyclic ring with the noted nitrogen atom in $NCS_2$, such as pentamethylenedithiocarbamate, pyrrolidinodithiocarbamate, and morpholinodithiocarbamate; xanthates represented by the formula ($R^2OCS_2$) wherein $R^2$ is alkyl containing 1 to 20 carbon atoms, such as methyl, ethyl, propyl, isopropyl, cyclohexyl and the like; dithiophosphates represented by the formula ($(R^2O)_2PS_2$); dithiophosphinates represented by the formula ($R^2{}_2PS_2$); dithiocarboxylates such as those represented by the formula ($R^3CS_2$) wherein $R^3$ is aryl, such as phenyl, naphthyl and substituted phenyl and naphthyl; dithioalkanes represented by the formula $R^4$—S—$(CH_2)$—$_n$S—$R^5$ wherein n is an integer from 1 to 6 and $R^4$ and $R^5$ are the same or different and are aryl such as phenyl, naphthyl, substituted phenyl and the like. Other useful bidentate ligands are described in the reference: D. Coucouvanis, *Prog. Inorganic Chemistry,* Volume 11, page 233 (1970).

Suitable tridentate sulfur-containing ligands include trithioalkanes represented by the formula $R^4$—S—$(CH_2)$—$_n$S—$(CH_2)$—$_n$S—$R^5$ wherein $R^4$, $R^5$ and n are as defined.

Useful tetradenate sulfur ligands include tetrathioalkanes represented by the formula $R^4$—S—$(CH_2)$—$_n$S—$(CH_2)$—$_n$S—$(CH_2)$—$_n$S—$R^5$ wherein $R^4$, $R^5$ and n are as defined. Macrocyclic ligands are also useful, such as the macrocyclic ligands described in the reference: K. Travis and D. H. Busch, *Inorganic Chemistry,* Vol. 13, beginning at page 2591 (1974).

Provided that at least one of the coordination positions of the tellurium (II) complex is occupied by a sulfur-containing ligand as described, the remaining positions, if any, can be occupied by either neutral or anionic ligands. Depending upon the combination of sulfur-containing ligands, neutral ligands and anionic ligands, the tellurium complex may have a valence, which is intended to mean a charge on the complex, of from 0 to 2. In instances in which a complex has a valence other than 0, a neutral salt of the complex can also be useful. In instances in which the complex itself is neutral, it can be used alone.

The term organotellurium (II) or (IV) "compound" and the term "complex" as used herein are intended to include any type of bonding or complexing mechanism which enables the resulting material to provide oxidizing agent properties and the described oxidation-reduction image-forming combination. In some instances the exact bonding of the described tellurium (II) and (IV) compounds is not fully understood. Accordingly, the terms "compound" and "complex" are intended to include salts and other forms of bonding which enable the desired oxidation-reduction image-forming combination. The terms organotellurium "compound" and "complex", as described, also are intended to include neutral complexes or salts of non-neutral complexes.

A wide variety of ligands known in the art can be useful. Typical neutral ligands useful herein are within the group Va or VIa donor atoms. Examples of these ligands are $P(C_6H_5)_3$; 1,10-phenanthroline; 2,2'-bipyridine and the like. Typical anionic ligands include halides such as chloro, bromo and iodo; ions which function like halides such as (NCO), (NCS), (NCSe), (NCTe) and the like; cyanoborohydride (i.e., $BH_3CN$); hydroborate anions such as ($BH_4$), ($B_3H_8$), ($B_9H_{14}$) and the like; carboxylates such as ($CH_3CO_2$), ($CF_3CO_2$) and the like; ($NO_2$); ($NO_3$); ($SO_4$); ($BF_4$); $B(C_6H_5)_4$; ($ClO_4$); ($PF_6$) and the like.

While a wide variety of organotellurium (II) or (IV) compounds or coordination complexes of tellurium (II) or (IV) are useful in the imaging materials as described, an especially useful group includes compounds or complexes wherein the tellurium (II) is complexed with two univalent bidentate sulfur-containing ligands.

The organotellurium (II) compound can be prepared by substitution reactions starting with a suitable inorganic tellurium (II) compound such as sodium tellurium thiosulfate and the like. The inorganic compound can be dissolved in a warm acid, such as hydrochloric or hydrobromic acid, and a warm aqueous solution of an alkali metal or ammonium salt of the desired bidentate anionic ligand is added. The desired organotellurium compound readily precipitates and can be recovered using separation methods known in the art.

Organotellurium compounds or complexes wherein the tellurium (II) is complexed with two bidentate sulfur-containing ligands are represented by the formula: $[Te(BL^1)(BL^2)]$ wherein $BL^1$ and $BL^2$ are the same or different and represent bidentate sulfur-containing ligands as described. Typical organotellurium (II) compounds which are useful include, for example:

$Te[S_2CN(C_2H_5)_2]_2$,

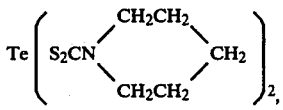

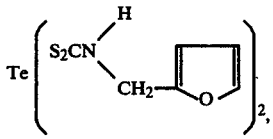

$Te(S_2COC_2H_5)_2$, $Te[S_2P(C_6H_{11})_2]_2$, $Te(S_2COC_6H_{13})_2$, $Te(S_2COC_5H_{11})_2$, $Te[S_2COCH(CH_3)_2]_2$, and $Te(S_2COC_{18}H_{37})_2$.

Another useful group of organotellurium compounds includes compounds wherein the tellurium (II) is complexed with two monodentate ligands which are neutral Lewis bases and contain sulfur donor atoms and with two ligands which are univalent anionic ligands. These compounds or complexes can be prepared by methods known in the art such as by ligand reduction of an organotellurium (IV) compound using the appropriate sulfur ligand as described. Organotellurium compounds of this group can be represented by the formula: $[Te(NML^1)(NML^2)(UAL^1)(UAL^2)]$ wherein $NML^1$ and $NML^2$ are the same or different and represent neutral Lewis base monodentate ligands containing sulfur donor atoms as described above; and $UAL^1$ and $UAL^2$ are the same or different and represent univalent anionic ligands also as described above. Typical organotellurium compounds within this group include, for example:

$[Te(thiourea)_2(Cl)_2]$, $[Te(thiourea)_2(SCN)_2]$, $[Te(1\text{-allyl-2-thiourea})_2(Cl)_2]$, and $[Te(1,3\text{-diallyl-2-thiourea})_2(Cl)_2]$.

A third useful group of organotellurium compounds includes compounds wherein the tellurium (II) is coordinated to four monodentate ligands which are neutral Lewis bases and contain sulfur donor atoms. All four ligands can be the same; or there can be two of one ligand and two of another ligand coordinated with the tellurium (II). These compounds have a valence, which is intended to mean a charge in the complex, of +2 and form salts with common anions. These compounds can be prepared by the same methods as those for the second group described using a large excess of the desired sulfur ligand. Organotellurium compounds of this third group can be represented by the formula:

$$[Te(NML^1)_2(NML^2)_2](UAL^1)(UAL^2)$$

wherein $NML^1$, $NML^2$, $UAL^1$ and $UAL^2$ are as described. Typical organotellurium compounds within this group include, for example:

$[Te(ethylenethiourea)_4]Cl_2$ and $[Te(1\text{-}(1\text{-naphthyl})\text{-2-thiourea})_4]Cl_2$.

Organotellurium compounds of the described groups to be most useful should be relatively pale-colored or colorless and capable of forming images of good definition due to the lack of color. These organotellurium compounds can be combined with a suitable reducing agent to provide imaging materials which can thermally deposit tellurium metal under the influence of acceptable catalytic centers, for example, Te(O), Cu(O), Pd(O), Au(O) and/or Ag(O).

Complexes of tellurium or organotellurium compounds which are useful according to the invention are also described in copending U.S. Patent application Ser. No. 703,405 of Gysling, filed July 8, 1976.

Coordination complexes of tellurium (IV), as described, are useful oxidizing agents in the imaging elements according to the invention. Examples of suitable tellurium (IV) coordination complexes include penta and hexahalo, such as chloro, bromo and iodo, complexes, including $[TeX_5]^{1-}$ and $[TeX_6]^{2-}$, wherein X is chlorine, bromine or iodine, and various mixed complexes, such as $[TeCl_4Br]^{2-}$ and the like. The counter cation of such anionic complexes can be an alkali or alkaline earth metal ion, a quaternary ammonium ion, $[N(P(C_6H_5)_3)_2]^+$ and other organometallic cations that do not adversely affect the desired imaging. Such halo complexes are described, for example instance, in G. A. Ozin and A. Vander Voet, J. Mol. Struct., 13, 435 (1972); B. Krebs and V. Paulat, Angew. Chem. (Internat. Ed.), 12, 666 (1973); and I. R. Beattie and H. Chudzynska, J. Chem. Soc. (A), 984 (1967), and in *Tellurium*, W. C. Cooper, editor, Van Nostrand Reinhold Co., N.Y., N.Y., 1971, pages 135–148. Other tellurium (IV) coordination complexes include those represented by the formula: $TeX_4.2L$, wherein X is chlorine, bromine or iodine, and L is a neutral ligand with a group Va or VIa donor atom. Examples of such complexes are $TeCl_4.2(C_6H_5N(CH_3)_2)$; $TeCl_2.2$ pyridine; $TeCl_4(RC_6H_4CH{=}NC_6H_5R')_a$ wherein a is 1 or 2, R and R′ are individually hydrogen, para-chlorine, para-bromine or para-$NO_2$; $TeX_4.2$ tetramethylthiourea, wherein X is chlorine or bromine; $TeCl_4.SR_2$ wherein R is alkyl, such as alkyl containing 1 to 5 carbon atoms, e.g., methyl, ethyl, propyl and butyl, or aryl, such as phenyl; and $TeCl_4.2$(2,6-lutidine-N-oxide).

Other useful tellurium (IV) compounds are tellurium (IV) coordination complexes with bidentate anionic ligands having group Va and VIa donor atoms, such as $Te(S_2CNR_2)_4$, wherein R is hydrogen, alkyl or aryl, as described. Examples of such compounds are described, for instance, in S. Husebye and S. E. Svaernen, Acta Chem. Scand., 29A, 185 (1975); $Te(O_2C_4H_6)_2$ described in P. J. Antikainen and P. J. Malkonen, Z.anorg. u.allgem. Chem., 299, 292 (1959).

Further useful tellurium oxidizing agents in imaging elements according to the invention include such tellurium (II) and (IV) derivatives as TeRR' and RTeTeR wherein R and R' are individually alkyl, aryl or acyl, as described; $TeR_nX_{4-n}$, wherein R is alkyl, aryl or acyl, as described, and X is Cl, Br, I, SCN, SeCN, CNO, $N_3$, $BH_3CN$, $O_2CR$ and the like, and n is 1 to 4.

Other useful organotellurium (II) and (IV) compounds are included, for instance, in K. J. Irgolic, *The Organic Chemistry of Tellurium,* Gordon and Breach Science Publishers, N.Y., N.Y., 1974 and K. J. Irgolic, J. Organometal. Chem., 103, 91 (1975).

The selection of an optimum organotellurium compound, as described, in an imaging element according to the invention will depend upon such factors as the particular reducing agent in the imaging material, processing conditions, desired image, and the like.

An especially useful tellurium (II) oxidizing agent is the coordination complex $Te[S_2CN(C_2H_5)_2]_2$. An especially useful tellurium (IV) oxidizing agent is $TeBr_2(CH_2C_6H_5)_2$.

If desired, the described organotellurium (II) and (IV) compounds can be prepared in situ in the heat-developable imaging materials according to the invention. However, due to the better control achieved by preparation of the organotellurium compound separate from other components of the described heat-developable materials, it is usually desirable to prepare the organotellurium (II) and (IV) compounds ex situ, that is, separate from other components of the described compositions. The organotellurium compounds then can be mixed with other components of the heat-developable materials as desired.

The described heat-developable imaging materials according to the invention need not include a photosensitive component. If desired, however, the described physically developable nuclei can be provided from a photosensitive compound, such as a photosensitive metal salt or complex.

Due to the amplification effects observed as a result of the presence of the oxidation-reduction image-forming combination, the concentration of physically developable nuclei can be lower than normally would be found useful. This lower concentration is enabled by the amplification effect of the oxidation-reduction image-forming combination as described. In some instances the concentration of metal salt that can provide the described physically developable nuclei can be lower than is visibly observable if the developed image were to be provided by the metal nuclei alone.

The heat-developable materials according to the invention can also comprise one or more other oxidizing agents than the described organotellurium (II) and (IV) oxidizing agent if desired. For example, the heat-developable materials according to the invention can contain a silver salt oxidizing agent such as a silver salt of a long-chain fatty acid. Such silver salt oxidizing agents are typically resistant to darkening upon illumination. Typically useful silver salts of long-chain fatty acids are those containing about 17 to 30 carbon atoms. Compounds which are useful silver salt oxidizing agents include, for example: silver behenate, silver stearate, silver oleate, silver laurate, silver hydroxystearate, silver caprate, silver myristate and silver palmitate. Silver salts which are not silver salts of long-chain fatty acids can be useful in combination with the described tellurium complexes also. Such silver salt oxidizing agents include, for example, silver benzotriazole, silver benzoate, silver terephthalate, silver complexes and the like. Examples of other heavy metal salt oxidizing agents are gold stearate, mercury behenate and gold behenate. Combinations of the described oxidizing agents can also be useful.

The described heat-developable elements and compositions can comprise a variety of reducing agents. These reducing agents can be organic reducing agents or inorganic reducing agents or combinations with organic reducing agents being preferred. Reducing agents which are especially useful are typically silver halide developing agents. Examples of useful reducing agents include phenolic reducing agents, such as polyhydroxybenzenes, including, for instance, hydroquinone, alkyl-substituted hydroquinones, including tertiary butyl hydroquinone, methyl hydroquinone, 2,5-dimethylhydroquinone and 2,6-dimethylhydroquinone; catechols and pyrogallols; chloro-substituted hydroquinones such as chlorohydroquinone or dichlorohydroquinone; alkoxy-substituted hydroquinones, such as methoxyhydroquinone or ethoxyhydroquinone; aminophenol reducing agents such as 2,4-diaminophenols and methylaminophenols; ascorbic acid reducing agents such as ascorbic acid, ascorbic acid ketals and ascorbic acid derivatives; hydroxylamine reducing agents; 3-pyrazolidone reducing agents such as 1-phenyl-3-pyrazolidone and 4-methyl-4-hydroxymethyl-1-phenyl-3-pyrazolidone; reductone reducing agents, such as 2-hydroxy-5-methyl-3-piperidino-2-cyclopentenone; sulfonamidophenol reducing agents such as the sulfonamidophenol reducing agents described in Research Disclosure, January 1973, pages 16–21; and the like. Combinations of reducing agents can be employed if desired. Selection of an optimum reducing agent or reducing agent combination will depend upon such factors as processing conditions, desired image, other components of the imaging material and the like.

A range of concentration of reducing agent is useful in the described heat-developable materials according to the invention. The optimum concentration will depend upon such factors as the particular photographic composition, processing conditions, desired image, and the like. Typically a concentration of about 0.1 to about 100 moles of reducing agent per mole of described oxidizing agent is employed in the heat-developable material according to the invention, preferably a concentration within the range of 0.5 to about 10 moles of reducing agent per mole of described oxidizing agent. A typical concentration of described reducing agent is, in a heat developable image element, about 0.1 to about 1000 mg/ft$^2$ of support which corresponds to 0.01 to 100 mg/dm$^2$. An especially useful concentration of described reducing agent is, in a heat developable imaging element, about 1 to 500 mg/ft$^2$ which corresponds to 0.1 to 50 mg/dm$^2$.

A useful embodiment of the invention comprises a heat-developable, imaging element or composition comprising in reactive association (a) physically developable nuclei, as described herein, (b) an oxidation-reduction image-forming combination comprising: (i) a tellurium (II) or (IV) compound as an oxidizing agent, typically an organotellurium compound which is a coordination complex of tellurium (II) with two univalent bidentate sulfur-containing ligands, and (ii) a reducing agent which is an organic reducing agent selected from the group consisting of sulfonamidophenol, ascorbic acid, 3-pyrazolidone, hydroquinone reductone and aminophenol reducing agents and combinations thereof, and (c) a polymeric binder. Useful inorganic reducing agents include, for example, those described in U.S. Pat. No. 3,598,587 of Yudelson et al, issued Aug. 10, 1971.

It is desirable, in some cases, to employ a stabilizer or a stabilizer precursor in the described heat-developable materials according to the invention to improve post-processing image stability. In some cases the tellurium complexes themselves are stable after processing. In other cases the physically developable nuclei are sufficiently stable to avoid need for a stabilizer or stabilizer precursor. If needed, a variety of stabilizer or stabilizer precursors can be used in the heat-developable materials as described. These stabilizers or stabilizer precursors can be used alone or in combination. Typical useful stabilizers or stabilizer precursors include photolytically-activated polybrominated organic compounds, such as described in U.S. Pat. No. 3,874,946 of Costa et al., issued Apr. 1, 1975 and blocked stabilizer precursors such as described in Belgian Pat. No. 768,071 issued July 30, 1971 and 4-aryl-1-carbamyl-2-tetrazoline-5-thione stabilizer precursors such as described in U.S. Pat. No. 3,893,859 of Burness et al, issued July 8, 1975.

A range of concentration of stabilizer or stabilizer precursor can be useful in the described heat-developable materials. An optimum concentration of stabilizer or stabilizer precursor will depend upon such factors as the particular heat-developable composition, processing conditions, desired stability of image, particular physically developable nuclei, and the like. A typical useful concentration range of stabilizer or stabilizer precursor is about 0.001 to about 100 moles of stabilizer or stabilizer precursor per mole of physically developable nuclei in the heat-developable material, preferably a concentration within the range of about 0.01 to about 10 moles of stabilizer or stabilizer precursor per mole of photographic component.

The heat-developable materials according to the invention can contain various colloids and polymers alone or in combination as vehicles, binding agents, and in various layers. Suitable materials can be hydrophobic or hydrophilic. They are transparent or translucent and include both naturally occurring substances such as proteins, for example, gelatin, gelatin derivatives, cellulose derivatives, polysaccharides, such as dextran, gum arabic and the like; and synthetic polymeric substances such as water-soluble polyvinyl compounds like poly(-vinyl pyrrolidone), acrylamide polymers and the like. Other synthetic polymeric compounds which can be employed include dispersed vinyl compounds such as in latex form and particularly those which increase dimensional stability of photographic materials. Effective polymers include water-insoluble polymers of alkyl acrylates and methacrylates, acrylic acid, sulfoalkyl acrylates, methacrylates, and those which have cross-linking sites which facilitate hardening or curing. Especially useful materials are high molecular weight materials and resins which are compatible with the described tellurium complexes, including poly(vinyl butyral), cellulose acetate butyrate, poly(methyl methacrylate), poly(vinyl pyrrolidone), ethylcellulose, polystyrene, poly(vinyl chloride), polyisobutylene, butadiene-styrene copolymers, vinyl chloride-vinyl acetate copolymers, copolymers of vinyl acetate, vinyl chloride and maleic acid, and poly(vinyl alcohol). Combinations of the described colloids and polymers can also be used.

It is in some cases useful to employ a so-called overcoat layer on the heat developable elements according to the invention to reduce fingerprinting and abrasion marks. The overcoat layer can be one or more of the described polymers which are also useful as binder or other polymeric materials which are compatible with the heat-developable layer and can tolerate the processing temperatures employed according to the invention.

The heat-developable materials according to the invention can contain hardeners, antistatic layers, plasticizers and lubricants, coating aids, brighteners, absorbing and filter dyes, as described in the *Product Licensing Index,* Vol. 92, Dec. 1971, publication 9232, pages 107–110.

The heat-developable elements according to the invention can comprise a variety of supports which can tolerate the processing temperatures employed according to the invention. Typical supports include cellulose ester film, poly(vinyl acetal) film, poly(ethylene terephthalate) film, polycarbonate film and polyester film supports as described in U.S. Pat. No. 3,634,089 of Hamb, issued Jan. 11, 1972 and U.S. Pat. No. 3,725,070 of Hamb et al, issued April 3, 1973 and related films and resinous materials, as well as glass, paper, metal and the like supports which can withstand the processing temperatures employed according to the invention. Typically a flexible support is employed.

The compositions according to the invention can be coated on a suitable support by various coating procedures known in the photographic art including dip coating, air-knife coating, curtain coating or extrusion coating using hoppers such as described in U.S. Pat. No. 2,681,294 of Beguin, issued June 15, 1954. If desired, two or more layers can be coated simultaneously such as described in U.S. Pat. No. 2,761,791 of Russell, issued Sept. 4, 1956 and British Pat. No. 837,095.

The described components of the heat-developable materials according to the invention can be in any suitable location in the heat-developable element according to the invention which provides the desired image. If desired, one or more of the components of the heat-developable element according to the invention can be in one or more layers of the element, preferably contiguous layers. For example, in some cases, it can be desirable to include certain percentages of the described reducing agents and/or other addenda in a protective layer over the heat-developable element. In some cases this can reduce migration of certain addenda between layers of the described element.

It is believed that the nuclei in the element increase the reaction rate and act as catalysts for the image-forming combination containing the tellurium complex and reducing agent in the heat-developable material according to the invention. It is believed that enables a lower processing temperature for amplification of the nuclei image than otherwise would be possible.

The term "in reactive association" is intended to mean that the described nuclei are in a location with respect to the other described components, especially the oxidation-reduction image-forming combination, of the materials according to the invention which enable this desired lower processing temperature and provides a more useful developed image.

If desired, other heat-developable materials can be used in combination with the heat-developable materials according to the invention containing tellurium complexes. For example, a heat-developable photographic element can comprise, respectively, a support having thereon a heat-developable layer comprising a tellurium complex according to the invention and a separate layer containing a photothermographic material containing photographic silver halide as a component with other necessary imaging materials. An example of such a heat-developable photographic material is one containing a heat-developable layer (I) contiguous to the organotellurium compound containing heat-developable layer (II), wherein layer (I) contains photographic silver halide in association with a silver salt of certain heterocyclic thione compounds and an organic reducing agent such as described in U.S. Pat. No. 2,983,860 of Sutton et al, issued July 8, 1975.

While a variety of organotellurium (II) and (IV) compounds and physically developable nuclei are useful in heat-developable elements and compositions according to the invention, an especially useful heat-developable material is a heat-developable imaging element comprising a support having thereon in reactive association (a) physically developable silver nuclei, especially an imagewise distribution of such nuclei, as described, (b) an oxidation-reducing image-forming combination comprising: (i) a tellurium bis(diethyl dithiocarbamate) oxidizing agent, and (ii) a pyrazolidone reducing agent, as described, and (c) a polymeric binder.

Another especially useful heat-developable material according to the invention is a heat-developable imaging element comprising a support having thereon in reactive association (a) physically developable nuclei, as described, (b) an oxidation-reduction image-forming combination comprising: (i) a tellurium di(isopropyl xanthate) oxidizing agent, and (ii) a pyrazolidone reducing agent, as described, and (c) a polymeric binder.

A further especially useful heat developable material according to the invention is a heat-developable imaging element comprising a support having thereon in reactive association (a) physically developable nuclei, as described, (b) an oxidation-reduction image-forming combination comprising: (i) a dibenzyl tellurium dibromide oxidizing agent and (ii) a phenolic reducing agent, as described, and (c) a polymeric binder.

Various means are useful with the materials according to the invention to provide the described physically developable nuclei. Typically an imaging element according to the invention is exposed imagewise with an energy source that is sufficient to provide a desired imagewise distribution of described nuclei. Such a source can be a laser or electron beam for example.

A visible image can be developed in a heat-developable material as described within a short time merely by overall heating of the heat-developable material. An image having a maximum reflection density of at least 1.0 and typically at least 1.5 can be provided according to the invention. For example, the heat-developable element can be heated to a temperature within the range of about 80° C. to about 220° C. until a desired image is developed, typically within about 1 to about 90 seconds. The heat-developable material according to the invention is preferably heated to a temperature within the range of about 100° to about 170° C. until the desired image is developed, such as within about 2 to about 60 seconds.

Another embodiment of the invention is a process of developing an image in an exposed, heat-developable imaging element, as described, comprising heating the element to within the range of about 80° C. to about 220° C. until a desired image is developed.

For example, an embodiment according to the invention is a process of developing an image in a heat-developable imaging element comprising a support having thereon in reactive association: (a) physically developable metal nuclei selected from the group consisting of tellurium, palladium, copper, gold and silver nuclei and combinations of said nuclei, especially an imagewise distribution of said nuclei, (b) an oxidation-reduction image-forming combination comprising (i) an organotellurium (II) or (IV) compound as an oxidizing agent, as described, and (ii) an organic reducing agent, also as described, and (c) a polymeric binder; comprising heating the element to a temperature within the range of about 80° C. to about 220° C. until a desired image is developed, such as for about 1 to about 30 seconds.

An especially useful embodiment of the invention is a process of developing an image in a heat-developable image element comprising a support having thereon in reactive association (a) physically developable metal nuclei, as described, (b) an oxidation-reduction image-forming combination comprising (i) a tellurium bis(-diethyl dithiocarbamate) oxidizing agent, or a tellurium di(isopropyl xanthate) oxidizing agent, or a dibenzyl tellurium dibromide oxidizing agent, and (ii) a reducing agent, and (c) a polymeric binder, comprising heating the element to within the range of about 100° C. to about 170° C. for about 1 to about 10 seconds.

The heat-developable materials according to the invention are useful for forming a negative or positive image. The formation of a negative or a positive image will depend primarily upon the selection of the reducing agent for the oxidation-reduction image-forming combination. A reducing agent which is useful for providing a positive image includes, for example, tert.-butylhydroquinone.

While silver nuclei are preferred physically developable metal nuclei according to the invention, other physically developable metal nuclei are useful for forming images according to the invention. Other physically developable nuclei which are useful include metal nuclei selected from the group consisting of chromium, iron, cobalt, nickel, copper, cadmium, selenium, palladium, silver, tin, tellurium, iridium, ruthenium, rhenium, platinum, rhodium, gold and lead nuclei and combinations of these nuclei or metal binary compounds, phosphides, sulfides, oxides, and the like. These nuclei can be provided from any suitable source of the metal nuclei such as compounds which are decomposable through various means to the desired metal nuclei. Such compounds include, for example: $K_2Pd(C_2O_4)_2$; $PbCl_2$; $K_3Co(C_2O_4)_3$; $[Co(NH_3)_5N_3]Cl_2$; and $Se(S_2COi\text{-}C_3H_7)_2$.

Especially useful physically developable metal nuclei are selected from the group consisting of tellurium, palladium, copper, gold and silver nuclei. These metal nuclei can be formed from photographic tellurium, palladium, copper, gold and/or silver compounds if desired. Examples of such compounds include: $Te(S_2P(OCH_3)_2)_2$; $K_2Pd(C_2O_4)_2$; $Pd(P(C_6H_5)_3)_2(C_2O_4)$; $[Cu(P(OCH_3)_3)_4]B(C_6H_5)_4$; $[Cu(P(OCH_3)_3)BH_3CN]_2$; $Cu(Sb(C_6H_5)_3)_3Cl$; and $[Cu(ethylenediamine)_2][B(C_6H_5)_4]_2$. Other photosensitive Pd complexes are described in U.S. Pat. No. 3,719,490 (Yudelson and Gysling, issued Mar. 6, 1973) and Research Disclosure 13705 (September 1975, B. F. Nellis). Other useful Cu complexes are described in U.S. Pat. No. 3,859,092 of Gysling and Vinal, issued Jan. 7, 1975; U.S. Pat. No. 3,860,500; U.S. Pat. No. 3,860,501; U.S. Pat. No. 3,927,055; and U.S. Pat. No. 3,880,724 of Gysling.

The class of organotellurium compounds that includes diorganoditellurides as oxidizing agents, as described, can be prepared by synthetic routes such as (1) reduction of an aryltellurium trichloride, (2) reaction of tellurium metal with an aryl lithium reagent, followed by aerial hydrolysis of the so formed LiTe aryl, or (3) reaction of tellurium metal with a Grignard reagent followed by aerial hydrolysis of the so formed MgX(Te) aryl. Other specialized methods of preparing these diorganoditellurides are also known in the art. Examples of diarylditellurides are represented by $Ar_2Te_2$ wherein Ar is $C_6H_5$, p-$CH_3OC_6H_4$, p-$CH_3C_6H_4$, p-$BrC_6H_4$ and 1-naphthyl.

The following examples are included for a further understanding of the invention.

EXAMPLE 1

Silver catalysis using tellurium di(methyl xanthate)

A heat-developable photographic element was prepared by coating the following solution on a resin-coated paper support at a wet coating thickness of 9 mils:

(A) 40 mg of tellurium di(methyl xanthate) was dissolved in 10 ml of a 2% by weight acetone-toluene (1:1 parts by volume) solution of poly(vinyl butyral), (B) 2 ml of a 10% by weight solution of 4-hydroxymethyl-4-methyl-1-phenyl-3-pyrazolidone in acetone-toluenedimethylformamide (45:45:10 parts by volume) was added to the resulting composition (A).

The resulting heat-developable photographic material was dried for 15 minutes at about 43° C.

The resulting element was laminated to a poly(ethylene terephthalate) film containing vacuum-deposited silver nuclei. The silver nuclei layer and the heat-developable layer containing the tellurium complex were in face-to-face contact. The resulting so-called sandwich was then passed between heated rollers at 150° C. at a rate which provided heating for 5 seconds at the designated temperature. This provided dark tellurium deposits of neutral tone in the areas in which the silver nuclei and the tellurium complex containing layer were in contact.

The minimum coverage of silver nuclei necessary for initiation of the desired imaging process was below 0.04 mg/ft$^2$ ($2\times10^{14}$ atoms/cm$^2$) of support.

The developed image according to this example had a maximum reflection density of 1.8 and a minimum reflection density of 0.1.

EXAMPLE 2

Use of various reducing agents in tellurium complex materials

The procedure described in Example 1 was repeated with the exception that the described pyrazolidone reducing agents designated in following Table I and Examples 2a-h were employed. The amplification reactions of the silver nuclei were carried out by the lamination technique described in Example 1 at the temperature and time designated in Example 1. In each instance, high density deposits (providing a maximum image density of at least 1.5) of tellurium metal were obtained with the reducing agents of Examples 2a-h.

Table I

Reducing Agents Used in Elements With $Te(S_2COCH_3)_2$

| Example | Reducing Agent | Amount Added to $Te(S_2COCH_3)_2$ Solution |
|---|---|---|
| 2a | 1-Phenyl-3-pyrazolidone | 2 ml of 10% solution in acetone-toluene-DMF (45:45:10 parts by volume) |
| 2b | Ascorbic acid | Same |
| 2c | 1-o-Tolyl-3-pyrazolidone | Same |
| 2d | 1-m-Tolyl-4,4-dimethyl-3-pyrazolidone | 2 ml of a 5% solution in acetone-toluene-DMF (45:45:10 parts by volume) |
| 2e | 4-Amino-2,6-dichlorophenol | 2 ml of a 10% solution in acetone-toluene (1:1 parts by volume) |
| 2f | tert.-Butylhydroquinone[a] | 1 ml of a 10% solution in acetone-toluene (1:1 parts by volume) |
| 2g | pyrazolidone[b,d] | 2 ml of a 10% solution in acetone-toluene-DMF (45:45:10 parts by volume) |
| 2h | reductone[b,e] | Same |

[a]This formulation gave a reversal image.
[b]These reducing agents resulted in some background darkening during thermal processing. Reducing agent[d] was 4,4-dimethyl-1-phenyl-3-pyrazolidone. Reducing agent[e] was 2-hydroxy-5-methyl-3-piperidino-2-cyclopentenone.
[c]DMF means dimethylformamide.

EXAMPLE 3

Silver-catalyzed tellurium complex containing element

A heat-developable element was prepared by coating the following solution at a wet coating thickness of 9 mils on a paper support as described in Example 1 followed by drying at 43° C.:

(A) 40 mg of $Te[S_2CN(C_2H_5)_2]_2$ dissolved in 10 ml of a 2% by weight acetone-toluene (1:1 parts by volume) solution of poly(vinyl butyral);

(B) 2 ml of a 10% by weight solution of 2-hydroxy-5-methyl-3-piperidino-2-cyclopentenone in acetone-toluenedimethylformamide (45:45:10 parts by volume) are added to the resulting composition (A).

The resulting heat-developable material was then laminated in face-to-face contact with a step tablet distribution of silver nuclei, vacuum deposited on a poly(ethylene terephthalate) film support. The resulting so-called sandwich was passed between heated rollers at a temperature of 175° C. to provide heating at this temperature for 15 seconds. This produced dark tellurium deposits of neutral (black) tone in the areas in which silver nuclei and the layer containing the tellurium complex were adjacent.

The example was repeated with the exception that the reducing agent described was replaced with 1-phenyl-3-pyrazolidone. Similar results were obtained.

The example was also repeated with the exception that the described reducing agent was replaced by para-benzylaminophenol. Similar results were observed.

The example was further repeated with the exception that the described reducing agent was replaced with ascorbic acid. Similar results were also observed with this reducing agent.

EXAMPLE 4

Copper-catalyzed tellurium complex

A tellurium complex containing element was prepared by coating the following solution on a resin-coated paper support at a wet coating thickness of 6 mils followed by drying for 15 minutes at about 43° C.:

| | |
|---|---|
| $Te(S_2CNEt_2)_2$ | 150 mg |
| 1-phenyl-3-pyrazolidone (reducing agent) | 200 mg |
| poly(vinyl butyral) (binder) | 375 mg |

The composition prior to coating on the paper support was dissolved in 9 ml of solvent consisting of acetone-toluene-dimethylformamide (45:45:10 parts by volume).

The resulting element was then laminated in face-to-face contact with a step tablet distribution of copper nuclei vacuum deposited on a poly(ethylene terephthalate) film support (prepared as in Example 1). The resulting so-called sandwich was heated by passing it between heated rollers at 160° C. for 10 seconds. This produced tellurium deposits of neutral (black) tone in the areas in which copper nuclei and the tellurium complex containing layer were adjacent. The coverage of copper nuclei on the poly(ethylene terephthalate) support, i.e., the critical coverage, was equal to or lower than $1.25\times10^{14}$ atoms/cm$^2$.

EXAMPLE 5

Palladium-catalyzed tellurium complex image formation

The procedure described in Example 4 was repeated with the exception that copper nuclei were replaced by palladium nuclei at a coverage of at least $1.56\times10^{14}$ atoms/cm$^2$.

Similar results to those obtained in Example 4 were observed using the palladium nuclei in place of the copper nuclei.

EXAMPLE 6

Gold-catalyzed tellurium complex image formation

The procedure described in Example 4 was repeated with the exception that the copper nuclei were replaced by gold nuclei at a gold coverage of $1.56\times10^{14}$ atoms/cm$^2$.

Results similar to those obtained in Example 4 were observed using the gold nuclei.

EXAMPLE 7

Electron exposure using tellurium complex materials

A tellurium complex containing element was prepared by mixing a composition consisting of the following:

| | |
|---|---|
| $Te(S_2CO\text{-}i\text{-}C_3H_7)_2$ | 130 mg |
| para-benzenesulfonamidophenol | 120 mg |
| 2,6-dichlorobenzenesulfon-aminodphenol | 23 mg |
| poly(vinyl butyral) | 375 mg |

The resulting composition was dissolved in 9.5 ml of acetone-toluene (1:1 parts by volume). The resulting composition was coated at a wet thickness of 6 mils on a poly(ethylene terephthalate) film support which had been previously coated with an electrically conductive layer of a commercially available CERMET. The coating was dried at 43° C.

The resulting element was exposed imagewise with electrons using a conventional electron gun. This provided a latent image of physically developable tellurium nuclei in the tellurium complex containing layer. The electron exposure was of $1.3\times10^{-7}$ coulombs/cm$^2$ (15 seconds, $8.7\times10^{-9}$ amperes/cm$^2$, 15 kiloelectronovolt electrons). The resulting exposed element was then heated at 110° C. for 5 seconds followed by heating for 5 seconds at 160° C. by contacting the exposed element with a metal block at the designated temperature. This produced a neutral (black) tellurium image in the areas exposed to electrons.

EXAMPLE 8

Use of $TeCl_4[(CH_3)_2NC_6H_5]_2$

An imaging element was prepared by coating the following solution on a resin coated paper support at a 9 mil wet coating thickness and permitting the resulting coating to dry for 5 minutes at 50° C.:

(a) 120.2 mg of $TeCl_4[(CH_3)_2NC_6H_5]_2$ was dissolved in 6 ml of a mixture of methanol and dimethylformamide solvent (1:1 parts by volume); and, (b) 12.88 ml of a 7.5% (by weight solution of poly(vinyl butyral) (Butvar B-76, which is a trade name of Monsanto Chemical Co., U.S.A.) in a mixture of dichloromethane and 1,1,2-trichloroethane (7:3 parts by volume) containing 100 mg of 2,6-dichloro-4-benzenesulfonamidophenol (reducing agent) was added to the composition.

The resulting imaging element was laminated in face-to-face contact with a step tablet distribution of silver nuclei which had been deposited on a poly(ethylene terephthalate) film support. The resulting sandwich was then processed by heating the sandwich by contacting it with a heated metal block at 170° C. for 30 seconds. This provided a tellurium image deposit of neutral tone in the areas in which the silver nuclei were contiguous to the described organotellurium oxidizing agent containing layer. The minimum coverage of silver nuclei necessary to provide a tellurium image deposit was $1.6\times10^{14}$ atoms/cm$^2$.

The process was repeated with the exception that a step tablet distribution of palladium nuclei was used in place of silver nuclei. The minimum coverage of palladium nuclei necessary to provide a tellurium image deposit was $2.1\times10^{14}$ atoms/cm$^2$.

EXAMPLE 9

Use of $TeCl_4[(CH_3)_2NC(S)N(CH_3)_2]_2$

A procedure similar to that described in Example 8 was carried out with the basic exception that $TeCl_4[(CH_3)_2NC(S)N(CH_3)_2]_2$ was used in place of the organotellurium compound of Example 8. Dichloromethane with 1,1,2-trichloroethane was used as a coating composition solvent.

The sandwich of the element containing the organotellurium compound with the element containing the step tablet distribution of silver nuclei was processed at 160° C. for 60 seconds. A developed tellurium image was produced.

EXAMPLE 10

Use of organotellurium (IV) compound and a borane reducing agent

An organotellurium (IV) compound, as described, can be useful with a borane reducing agent to provide image amplification of a palladium nuclei image.

An imaging element was prepared by coating a solution of 150 mg of $TeCl_2(p\text{-}CH_3C_6H_4)_2$ and 150 mg of triphenylphosphine borane, $(P(C_6H_5)_3BH_3)$, in 8 ml of a 4% by weight $CHCl_3$ solution of a poly(vinyl acetal) (Formvar 15/95E which is a trade name of the Monsanto Chemical Co., U.S.A.) on a poly(ethylene terephthalate film support at a 9 mil wet coating thickness. The resulting coating was permitted to dry. Then the element containing the organotellurium compound was laminated in face-to-face contact with an element having a step tablet distribution of palladium nuclei on a poly(ethylene terephthalate) film support. The resulting sandwich was then processed by contacting it with a heated metal block at 160° C. for 30 seconds. A tellurium image was produced.

EXAMPLE 11

Use of tellurium dibenzyl bromide

A heat developable, imaging element was prepared by coating the following solution on a resin coated paper support at a 4 mil wet coating thickness followed by drying for 15 minutes at 43° C. (110° F.)

| | |
|---|---|
| tellurium dibenzyl bromide (prepared from $TeCl_4$ with benzyl HgCl in dioxane) | 100 mg |
| 2,2'-methylene bis(6-tertiary-butyl-4-methylphenol) (reducing agent) | 150 mg |
| poly(vinyl butyral) (binder) (BUTVAR B-76, trade name of Monsanto Co., U.S.A.) | 600 mg |

These components were dissolved in 7 ml of dichloromethane-1,1,2-trichloroethane (7:3) solvent prior to coating. The resulting imaging element was then laminated face to face with an imagewise (step tablet) distribution of silver nuclei vacuum deposited on a poly(ethyleneterephthalate) film support. The resulting so-called sandwich was then heated for 30 seconds at 180° C. to provide developed tellurium deposits of neutral (black) tone in the areas in which the silver nuclei were present.

The minimum coverage of silver nuclei necessary for initiation of the desired imaging process was about $6\times10^{13}$ atoms/cm$^2$.

EXAMPLE 12

Use of tellurium dibenzyl bromide with gold nuclei

The procedure described in Example 11 was repeated with the exception that gold nuclei were used in place of silver nuclei.

The minimum coverage of gold nuclei necessary for initiation of the desired imaging process was less than about $6.2\times10^{13}$ atoms/cm$^2$.

EXAMPLE 13

Use of tellurium dibenzyl bromide with palladium nuclei

The procedure described in Example 11 was repeated with the exception that palladium nuclei were used in place of silver nuclei.

The minimum coverage of palladium nuclei necessary for initiation of the desired imaging process was less than about $3.1\times10^{14}$ atoms/cm$^2$.

EXAMPLE 14

Use of $C_6H_5TeTeC_6H_5$

An imaging element was prepared as follows: 100 mg of $C_6H_5TeTeC_6H_5$ and 100 mg of dimethylamineborane were dissolved in 10 ml of a 4% by weight chloroform solution of poly(vinyl acetal) (Formvar 15/95 which is a trade name of the Monsanto Chemical Co., U.S.A.) and coated at a 9 mil wet coating thickness on a poly(ethylene terephthalate) film support. The coating was permitted to dry. The element was then laminated in face-to-face contact with a step tablet distribution of palladium nuclei on a poly(ethylene terephthalate) film support. The resulting sandwich was then heated by contacting it with a metal block at a temperature of 150° C. for 10 seconds. Amplification of the palladium image with tellurium was observed to provide a visible, grey-black, developed image.

Similar results were provided with the use, individually, of $(p\text{-}CH_3C_6H_4)_2Te_2$, $(p\text{-}CH_3OC_6H_4)_2Te$, $(p\text{-}BrC_6H_4)_2Te_2$, and $(1\text{-naphthyl})_2Te_2$ in place of $C_6H_5TeTeC_6H_5$.

Another useful organotellurium (II) oxidizing agent is $Te(p\text{-}CH_3O\text{-}C_6H_4)_2$ and other useful organotellurium (IV) oxidizing agents are $TeCl_2(CH_2C(O)\text{-}o\text{-}CH_3O\text{-}C_6H_4)_2$, $Te(p\text{-}CH_3O\text{-}C_6H_4)_2Cl_2$ and $Te(C_6H_4OCH_3)_2Cl_2$.

The invention has been described in detail with particular reference to preferred embodiments thereof, but it will be understood that variations and modifications can be effected within the spirit and scope of the invention.

What is claimed is:

1. A heat developable, imaging element comprising a support having thereon in reactive association
   a. physically developable metal nuclei selected from the group consisting of chromium, iron, cobalt, nickel, copper, cadmium, selenium, palladium, silver, tin, tellurium, iridium, ruthenium, rhenium, platinum, gold and lead nuclei and combinations of said nuclei,
   b. an oxidation-reduction image-forming combination comprising
      i. an orgnotellurium (II) or (IV) compound as an oxidizing agent, and
      ii. a reducing agent, and
   c. a binder.

2. A heat developable, imaging element as in claim 1 wherein said tellurium compound is a coordination complex of tellurium (II) or (IV).

3. A heat developable, imaging element as in claim 1 wherein said tellurium compound is a coordination complex of tellurium (II) with two univalent bidentate sulfur-containing ligands.

4. A heat developable, imaging element as in claim 1 wherein said compound is selected from the group consisting of $Te(S_2COCH_3)_2$,
$Te(S_2COC_2H_5)_2$,
$Te(S_2P(C_6H_{11})_2)_2$,
$Te(S_2COC_{10}H_{21})_2$,
$Te(S_2P(OC_6H_5)_2)_2$,
$Te(S_2P(OC_2H_5)_2)_2$,
$Te(S_2CN(C_2H_5)_2)_2$,
$Te(S_2CN(CH_2C_6H_5)_2)_2$,
$Te(p\text{-}CH_3O\text{-}C_6H_4)_2$,
$C_6H_5TeTeC_6H_5$,
$Te(p\text{-}CH_3O\text{-}C_6H_4)_3Cl$,
$Te(C_6H_4OCH_3)_2Cl_2$,
$TeCl_2(CH_2C(O)\text{-}o\text{-}CH_3O\text{-}C_6H_4)_2$,
$TeBr_2(CH_2C_6H_5)_2$,
$Te(S_2COC_5H_{11})_2$, and
$Te(S_2COCH(CH_3)_2)_2$.

5. A heat developable, imaging element as in claim 1 wherein said organotellurium (II) or (IV) compound consists essentially of $Te[S_2CN(C_2H_5)_2]_2$ or $TeBr_2(CH_2C_6H_5)_2$.

6. A heat developable, imaging element as in claim 1 wherein said reducing agent is an organic reducing agent selected from the group consisting of sulfonamidophenol, ascorbic acid, 3-pyrazolidone, hydroquinone, reductone and aminophenol reducing agents and combinations thereof.

7. A process of developing an image in a heat developable, imaging element as defined in claim 3 comprising heating said element to within the range of about 80° C. to about 220° C.

8. In a heat developable, imaging composition comprising a. physically developable metal nuclei,
b. an oxidation-reduction image-forming combination comprising:
   i. a non-silver metal compound as an oxidizing agent, and
   ii. a reducing agent, and
c. a binder, the improvement wherein said non-silver metal compound as an oxidizing agent consists essentially of an organotellurium (II) or (IV) compound.

9. A heat developable, imaging composition as in claim 8 wherein said tellurium compound is a coordination complex of tellurium (II) or (IV).

10. A heat developable, imaging composition as in claim 8 wherein said tellurium compound is a coordination complex of tellurium (II) with two univalent bidentate sulfur-containing ligands.

11. A heat developable, imaging composition as in claim 8 wherein said tellurium compound is selected from the group consisting of $Te(S_2COCH_3)_2$,
$Te(S_2COC_2H_5)_2$,
$Te(S_2P(C_6H_{11})_2)_2$,
$Te(S_2COC_{10}H_{21})_2$,
$Te(S_2P(OC_6H_5)_2)_2$,
$Te(S_2P(OC_2H_5)_2)_2$,
$Te(S_2CN(C_2H_5)_2)_2$,
$Te(S_2CN(CH_2C_6H_5)_2)_2$,
$Te(p\text{-}CH_3O\text{-}C_6H_4)_2$,
$C_6H_5TeTeC_6H_5$,
$Te(p\text{-}CH_3O\text{-}C_6H_4)_3Cl$,
$Te(C_6H_4OCH_3)_2Cl_2$,
$TeCl_2(CH_2C(O)\text{-}o\text{-}CH_3O\text{-}C_6H_4)_2$,
$TeBr_2(CH_2C_6H_5)_2$,
$Te(S_2COC_5H_{11})_2$, and
$Te(S_2COCH(CH_3)_2)_2$.

12. A heat developable, imaging composition as in claim 8 wherein said reducing agent is an organic reducing agent selected from the group consisting of sulfonamidophenol, ascorbic acid, 3-pyrazolidone, hydroquinone, reductone and aminophenol reducing agents and combinations thereof.

13. In a heat developable, imaging element comprising a support having thereon in reactive association a. physically developable metal nuclei,
b. an oxidation-reduction image-forming combination comprising:
   i. a non-silver metal compound as an oxidizing agent, and
   ii. a reducing agent, and
c. a binder, the improvement wherein said non-silver metal compound as an oxidizing agent consists essentially of an organotellurium (II) or (IV) compound.

14. A process of developing an image in a heat developable, imaging element as defined in claim 13 wherein said tellurium compound is a coordination complex of tellurium (II) with two univalent bidentate sulfur-containing ligands, comprising heating said element to within the range of about 80° C. to about 220° C.

15. A heat developable, imaging element comprising a support having thereon in reactive association a. physically developable silver nuclei,
b. an oxidation-reduction image-forming combination comprising:
   i. a tellurium bis(diethyl dithiocarbamate) oxidizing agent, and
   ii. a pyrazolidone reducing agent, and
c. a polymeric binder.

16. A heat developable, imaging element comprising a support having thereon in reactive association a. physically developable silver nuclei,
b. an oxidation-reduction image-forming combination comprising:
   i. a tellurium di(isopropyl xanthate) oxidizing agent, and
   ii. a pyrazolidone reducing agent, and
c. a polymeric binder.

17. A heat developable, imaging composition comprising a. physically developable silver nuclei,
b. an oxidation-reduction image-forming combination comprising:
   i. a tellurium bis(diethyl dithiocarbamate) oxidizing agent, and
   ii. a pyrazolidone reducing agent, and
c. a polymeric binder.

18. A heat developable, imaging composition comprising a. physically developable silver nuclei,
b. an oxidation-reduction image-forming combination comprising:
   i. a tellurium di(isopropyl xanthate) oxidizing agent, and ii. a pyrazolidone reducing agent, and c. a polymeric binder.

19. A process of developing an image in a heat developable, imaging element comprising a support having thereon, in reactive association, a. physically developable metal nuclei selected from the group consisting of copper, tellurium, palladium and silver nuclei and combinations of such nuclei, b. an oxidation-reduction image-forming combination comprising i. an organotellurium compound as an oxidizing agent and which is selected from the group consisting of $Te(S_2COCH_3)_2$,
$Te(S_2COC_2H_5)_2$,
$Te(S_2P(C_6H_{11})_2)_2$,
$Te(S_2COC_{10}H_{21})_2$,
$Te(S_2P(OC_6H_5)_2)_2$,
$Te(S_2P(OC_2H_5)_2)_2$,
$Te(S_2CN(C_2H_5)_2)_2$,
$Te(S_2CN(CH_2C_6H_5)_2)_2$,
$Te(p\text{-}CH_3O\text{-}C_6H_4)_2$,
$C_6H_5TeTeC_6H_5$,
$Te(p\text{-}CH_3O\text{-}C_6H_4)_3Cl$,
$Te(C_6H_4OCH_3)_2Cl_2$,
$TeCl_2(CH_2C(O)\text{-}o\text{-}CH_3O\text{-}C_6H_4)_2$,
$TeBr_2(CH_2C_6H_5)_2$,
$Te(S_2COC_5H_{11})_2$, and
$Te(S_2COCH(CH_3)_2)_2$, ii. an organic reducing agent, and c. a polymeric binder, comprising heating said element to within the range of about 80° C. to about 220° C. for about 1 to about 30 seconds.

20. A process of developing an image in a heat developable, imaging element comprising a support having thereon in reactive association a. physically developable silver nuclei, b. an oxidation-reduction image-forming combination comprising i. a tellurium bis(diethyl dithiocarbamate) oxidizing agent, and ii. a pyrazolidone reducing agent, and c. a polymeric binder, comprising heating said element to within the range of about 100° C. to about 170° C. for about 1 to about 10 seconds.

21. A process of developing an image in a heat developable, imaging element comprising a support having thereon in reactive association a. physically developable silver nuclei, b. an oxidation-reduction image-forming combination comprising i. a tellurium di(isopropyl xanthate) oxidizing agent, and ii. a pyrazolidone reducing agent, and c. a polymeric binder, comprising heating said element to within the range of about 100° C. to about 170° C. for about 1 to about 10 seconds.

* * * * *

UNITED STATES PATENT AND TRADEMARK OFFICE

CERTIFICATE OF CORRECTION

PATENT NO. : 4,152,155

DATED : May 1, 1979

INVENTOR(S) : Mark Lelental and Henry J. Gysling

It is certified that error appears in the above-identified patent and that said Letters Patent are hereby corrected as shown below:

Column 2, line 58, "as tellurium" should read ---a tellurium---.

Column 4, line 21, "tetradenate" should read ---tetradentate---.

Column 6, line 56, "$TeX_4.2L$" should read --- $TeX_4 \cdot 2L$ ---; line 59, "$TeCl_4.2(C_6H_5N(CH_3)_2)$" and "$TeCl_2.2$" should read --- $TeCl_4 \cdot 2(C_6H_5N(CH_3)_2)$ --- and --- $TeCl_2 \cdot 2$ ---; line 62, "$TeX_4.2$" should read --- $TeX_4 \cdot 2$ ---; line 63, "$TeCl_4.SR_2$" should read --- $TeCl_4 \cdot SR_2$ ---; line 66, "$TeCl_4.2$(2,6-lutidine-N-oxide)" should read --- $TeCl_4 \cdot 2$(2,6-lutidine-N-oxide) ---.

Column 11, line 18, "2,983,860" should read ---3,893,860---; line 27, "oxidation-reducing" should read --- oxidation-reduction ---.

UNITED STATES PATENT AND TRADEMARK OFFICE

CERTIFICATE OF CORRECTION

PATENT NO. : 4,152,155

DATED : May 1, 1979

INVENTOR(S) : Mark Lelental and Henry J. Gysling

It is certified that error appears in the above-identified patent and that said Letters Patent are hereby corrected as shown below:

Column 12, line 24, "image element" should read ---imaging element---.

Column 16, lines 10-11, "2,6-dichlorobenzenesulfonaminodphenol" should read --- 2,6-dichlorobenzenesulfonamidophenol ---.

Signed and Sealed this

*Eleventh* Day of *September 1979*

[SEAL]

*Attest:*

*Attesting Officer*

LUTRELLE F. PARKER

*Acting Commissioner of Patents and Trademarks*